US010605052B2

(12) United States Patent
Zhang et al.

(10) Patent No.: US 10,605,052 B2
(45) Date of Patent: Mar. 31, 2020

(54) THERMAL MANAGEMENT SYSTEM FOR DOWNHOLE TOOLS

(71) Applicant: Halliburton Energy Services, Inc., Houston, TX (US)

(72) Inventors: Lizheng Zhang, Humble, TX (US); Tanest Chinwanawich, Houston, TX (US); Adan Herrera, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/768,860

(22) PCT Filed: Nov. 19, 2015

(86) PCT No.: PCT/US2015/061578
§ 371 (c)(1),
(2) Date: Apr. 17, 2018

(87) PCT Pub. No.: WO2017/086974
PCT Pub. Date: May 26, 2017

(65) Prior Publication Data
US 2019/0055817 A1 Feb. 21, 2019

(51) Int. Cl.
*E21B 36/00* (2006.01)
*E21B 47/01* (2012.01)

(52) U.S. Cl.
CPC ..... *E21B 36/001* (2013.01); *E21B 47/011* (2013.01)

(58) Field of Classification Search
CPC ..... E21B 36/001; E21B 47/011; H05K 2201/066; H05K 1/021
USPC ..... 361/700–722; 166/302
See application file for complete search history.

(56) References Cited

U.S. PATENT DOCUMENTS 3,774,078 A 11/1973 Martin
4,407,136 A * 10/1983 de Kanter ..... E21B 36/001 165/104.21
4,433,724 A 2/1984 Nagano
4,513,352 A * 4/1985 Bennett ..... H05K 7/20336 165/902
5,201,866 A 4/1993 Mok
5,870,287 A 2/1999 Rodriguez
5,931,000 A 8/1999 Turner
5,982,621 A 11/1999 Li
6,134,112 A 10/2000 Lecornu
(Continued)

OTHER PUBLICATIONS

International Search Report and Written Opinion of PCT Application No. PCT/US2015/061578 dated Aug. 18, 2016: pp. 1-16.
(Continued)

*Primary Examiner* — Anatoly Vortman
(74) *Attorney, Agent, or Firm* — Chamberlain Hrdlicka

(57) ABSTRACT

A downhole tool system includes a tool housing, a chassis located within the tool housing, and an electronics assembly positioned on the chassis within the tool housing. The electronics assembly includes a heat sink comprising an inner surface and an outer surface. The outer surface includes a tapered portion and in is contact with the tool housing. The electronics assembly further includes one or more electronic components mounted onto the heat sink, in which at least a portion of the electronic components is in contact with the inner surface of the heat sink.

10 Claims, 5 Drawing Sheets

(56) References Cited

U.S. PATENT DOCUMENTS 6,150,601 A * 11/2000 Schnatzmeyer .... E21B 41/0085 136/201
6,161,610 A 12/2000 Azar
6,305,174 B1 * 10/2001 Binneberg ..... B64G 1/50 62/383
6,639,801 B2 10/2003 Miner
6,938,991 B2 * 9/2005 Silverbrook ..... B05D 3/08 347/54
7,440,283 B1 * 10/2008 Rafie ..... E21B 47/011 165/185
7,806,173 B2 * 10/2010 Kaul ..... E21B 47/011 166/57
8,220,545 B2 * 7/2012 Storm, Jr. ..... E21B 47/011 166/302
8,322,411 B2 12/2012 Kaul
8,410,672 B2 4/2013 Rebergen
8,479,820 B2 7/2013 Kaul
8,820,397 B2 9/2014 Marzouk
8,826,984 B2 9/2014 Sanderlin et al.
2005/0161215 A1 * 7/2005 Hall ..... E21B 47/01 166/242.6
2006/0086506 A1 4/2006 Golla
2006/0144619 A1 7/2006 Storm
2011/0203798 A1 * 8/2011 Herrera ..... E21B 47/011 166/302
2011/0272135 A1 * 11/2011 Kaul ..... E21B 36/001 166/57
2011/0272154 A1 * 11/2011 Kaul ..... E21B 36/001 166/272.1
2012/0048531 A1 3/2012 Marzouk et al.
2013/0025886 A1 * 1/2013 Martinez ..... E21B 47/011 166/386
2013/0126171 A1 5/2013 Garnier
2013/0148300 A1 * 6/2013 Hovik ..... E21B 47/011 361/700
2014/0076531 A1 3/2014 Hallundbaek
2015/0211335 A1 * 7/2015 Boyle ..... E21B 43/24 166/302
2016/0145996 A1 * 5/2016 Goodman ..... E21B 36/001 166/243
2016/0265289 A1 * 9/2016 Goodman ..... E21B 19/00
2019/0055817 A1 * 2/2019 Zhang ..... E21B 47/011

OTHER PUBLICATIONS

Beckwith, Robin, "Downhole Electronic Components: Achieving Performance Reliability", SPE-0813-0042, JPT, Aug. 2013, pp. 43-57.

* cited by examiner

THERMAL MANAGEMENT SYSTEM FOR DOWNHOLE TOOLS

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

Downhole tools, such as logging tools, steering and measurement tools, drilling tools, among others, are typically sent into boreholes formed deep within the earth. These tools may often be subject to the high temperatures of the downhole environment. Most downhole tools include an electronics portion. These downhole electronics are usually packaged in an atmospheric environment inside a pressure housing. In some cases, the temperature in the borehole can exceed the operating limit of some electronics components. In such cases, components with high temperature ratings may be selected by design, or various mechanisms are used to keep the electronics temperature below the operating limit. Such mechanism may include but are not limited to thermal flasks, thermoelectric coolers, heat pipes, etc.

Additionally, aside from high bolehole temperatures, many of these electronic components are power-consuming electronics which may generate a large amount of heat on their own. This can also cause component temperature to rise beyond the operating limit if the generated heat is not managed properly. For example, even the most power efficient metal-oxide-semiconductor field-effect transistors (MOSFETs) and insulated-gate bipolar transistors (IGBTs) can generate significant amount of heat during operation. Thus, heat management is an ongoing object of downhole tool design.

BRIEF DESCRIPTION OF THE DRAWINGS

For a detailed description of the embodiments of the invention, reference will now be made to the accompanying drawings in which.

DETAILED DESCRIPTION

The present disclosure provides methods and systems for increasing heat dissipation from electronics inside of downhole tools by providing a thermal pathway between heat generating electronics and the outer housing of the downhole tool, thereby dissipating heat into the environment. The present disclosure provides a heat sink which contacts both the heat generating electronics as well as the tool housing to establish such a thermal pathway. The heat sink may also have a tapered shape to provide ease of installation as well as good contact.

Figure 1:
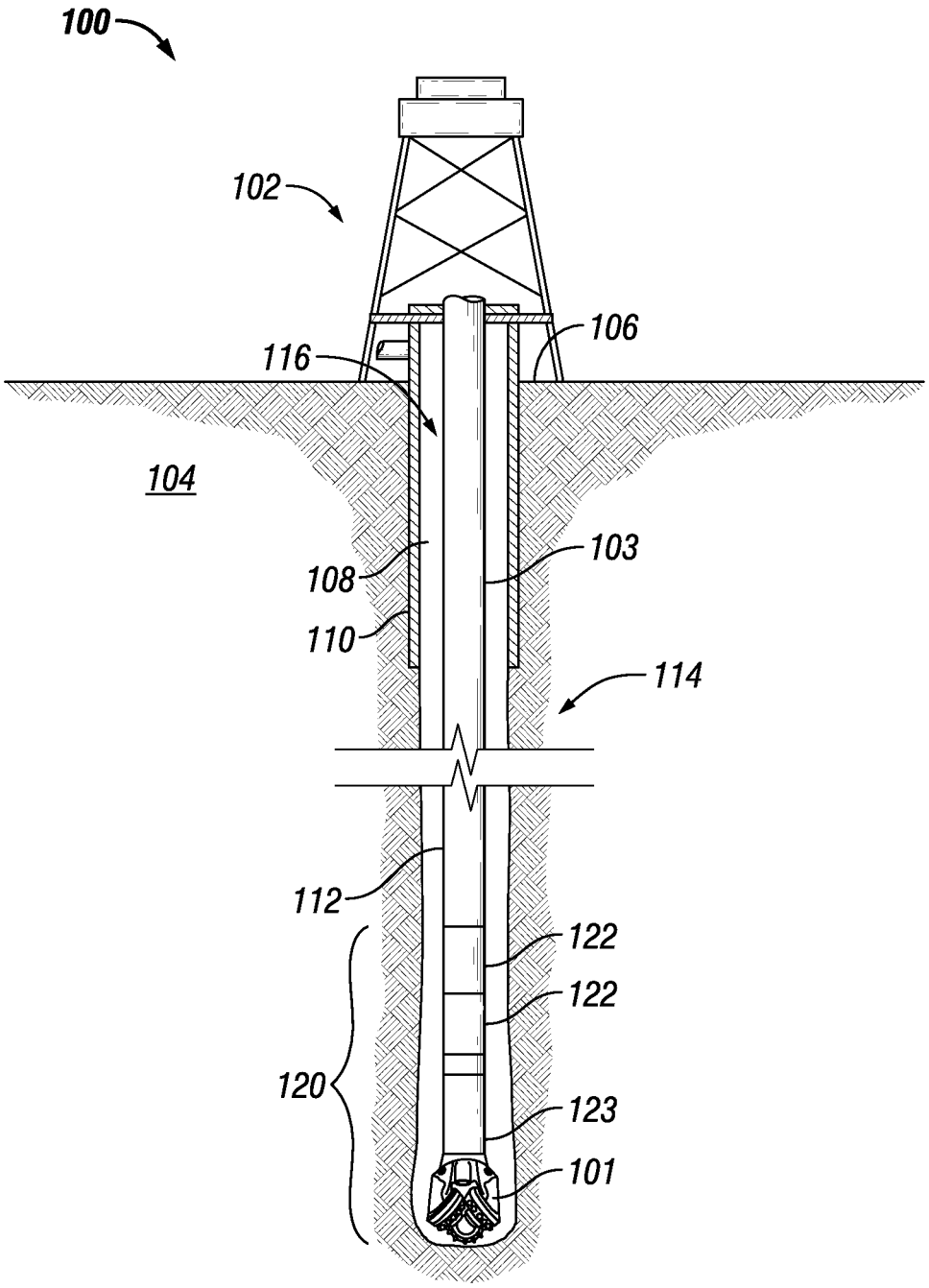
FIG. 1 illustrates a schematic view of an example well operation.

Turning now to the figures, FIG. 1 illustrates a schematic view of an example well operation 100. The particular example illustrates a well 114 being formed by a drilling system 116 within a formation 104. However, other equally applicable examples of well operations 100 incorporating the teachings of the present disclosure may include well completion operations, logging operations, production operations, and any other type of well operation. In the present example, various types of drilling equipment such as a rotary table, drilling fluid pumps and drilling fluid tanks (not expressly shown) may be located at a well site 106. For example, the well site 106 may include a drilling rig 102 that has various characteristics and features associated with a "land drilling rig." The example well operation illustrated in FIG. 1 is a land-based drilling operation. However, well operations 100 incorporating teachings of the present disclosure may also include offshore operations, and thus utilize drilling equipment located on offshore platforms, drill ships, semi-submersibles and drilling barges (not expressly shown).

The well 114 may be a vertical well, such as that illustrated in FIG. 1. In some embodiments, the well 114 may be a horizontal well or a directional well having a range of angles. The well 114 may be defined at least in part by a casing string 110 that may extend from the surface of the well site 106 to a selected downhole location. Portions of the well 114 that do not include the casing string 110 may be described as "open hole."

The drilling system 116 may include a drill string 103 suspended downhole from the well site 106. The drill string 103 includes a drill pipe 112 and a bottom hole assembly (BHA) 120. The drill pipe 112 may include a plurality of segments, each of which are added to the drill pipe 112 as the well 114 is drilled and increasing length of drill pipe 112 is required. The drill pipe 112 provides the length required for the BHA 120 to reach well bottom and drill further into the formation. The drill pipe 112 may also deliver drilling fluid from surface facilities at the well site 106 to the BHA 120.

The BHA 120 may include one or more of a wide variety of downhole tools 122 and components configured to carry out the functions of the well operation 100, such as to form the wellbore 114. Such tools 122 may include, but are not limited to, logging while drilling (LWD) or measurement while drilling (MWD) tools, rotary steering tools, directional drilling tools, motors, reamers, hole enlargers or stabilizers, among others. Many of these downhole tools 122 include electronic components which generate heat inside of the tool 122. The number and types of tools 122 included in the BHA 120 may depend on anticipated downhole drilling conditions and the type of wellbore that is to be formed.

Accordingly, other types of well operations 100 will include other types of downhole tools 122 for carrying out the functions of the respective well operation 100. In some embodiments, the BHA 120 includes a power generation unit 123 which may also be considered a type of downhole tool 122. The power generation unit 123 may be a mud-based power generator that includes a turbine that rotates when traversed by drilling fluid, thereby generating power.

The drill string 103 also includes a drill bit 101 for cutting through the formation. In most wells 114, there is a space between the downhole tools 122 and the walls of the well 114 called an annulus 108. In some embodiments, such as in a drilling operation, drilling fluid may flow through the annulus 108. In a production operation, production fluid may flow through the annulus 108.

As noted, the example well operation illustrated in FIG. 1 is a land-based drilling operation. However, well operations 100 incorporating teachings of the present disclosure may also include offshore operations, and thus utilize drilling equipment located on offshore platforms, drill ships, semi-submersibles and drilling barges (not expressly shown). Additionally, other examples of well operations 100 incorporating the teachings of the present disclosure may include well completion operations, logging operations, production operations, and any other type of well operation which utilizes a downhole tool 122 having electronic components.

Figure 2:
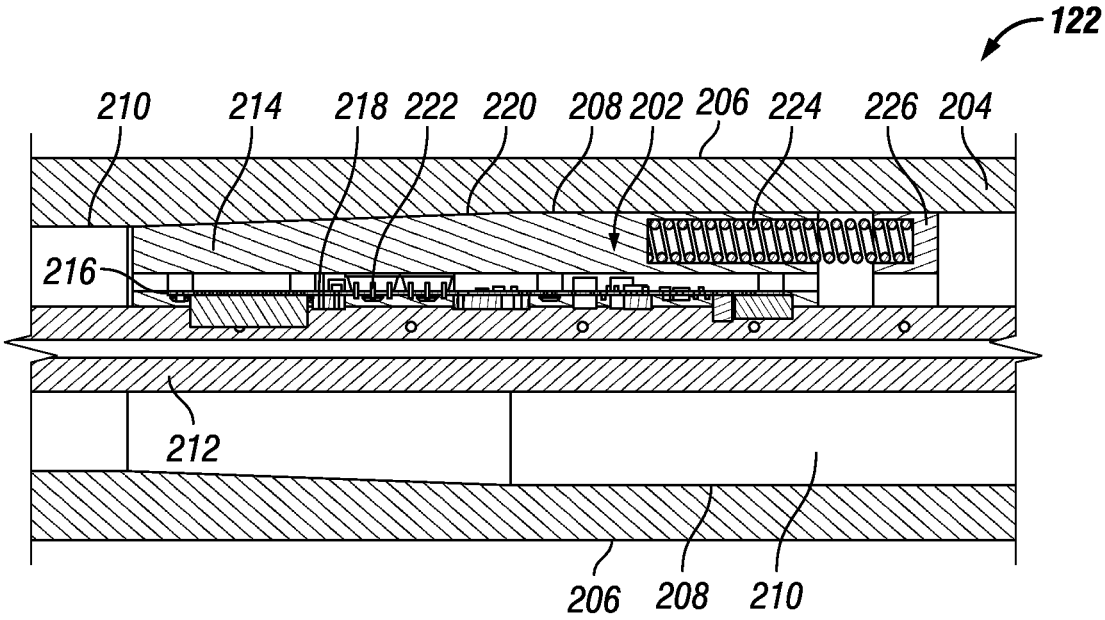
FIG. 2 illustrates a cross-sectional view of portion of a downhole tool that includes an electronics assembly.

FIG. 2 illustrates a cross-sectional view of portion of a downhole tool 122, which includes an electronics assembly 202. The tool 122 includes a tool housing 204 with an outer surface 206 and an inner surface 208. The outer surface 206 is typically exposed to the annulus 108 and the inner surface 208 defines an orifice 210 that houses internal components of the tool 122. A chassis 212 is located within the tool housing 204 and provides a mounting support for the electronics assembly 202. The chassis 212 may be any type of structure fixed to the tool housing 204 to which the electronics assembly can be attached.

The electronics assembly 202 is coupled to the chassis within the tool housing 204 and between the chassis and the tool housing 204. The electronics assembly 202 includes a heat sink 214 and a circuit board assembly 216, such as a printed circuit board assembly (PCBA). The circuit board assembly 216 is mounted onto the heat sink 214. In some embodiments, the circuit board assembly 216 includes a plurality of various electronic components such as processors, transistor devices, circuit elements, among many other possible components. The electronic components may include one or more heat generating components 222.

The heat sink 214 includes an inner surface 218 and an outer surface 220. The electronics board is mounted to the heat sink 214 such that the one or more heat generating components 222 are in contact with the inner surface 218 of the heat sink 214. Specifically, the heat generating components 222 may include a heat dissipating surface which is put in contact with the inner surface 218 of the heat sink 214. In some embodiments, when the electronics assembly 202 is fully installed in the downhole tool 122, the outer surface 220 of the heat sink 214 is in contact with the inner surface 208 of the tool housing 204. The heat sink 214 may be fabricated from thermally conductive materials such as plastic, aluminum, copper, among others, which enable heat transfer between the inner surface 218 and the outer surface 220. This allows heat dissipated from the heat generating components 222 to be transferred to the heat sink 214 and then to the tool housing 204 via the heat sink 214. The heat can then be dissipated out of the tool housing 204 and into the annulus 106, thus reducing the temperature rise of heat producing components 222 and other components on the circuit board assembly 216. The arrows indicate a thermally conductive path for dissipation of heat from the components 222 to the housing 204 through the heat sink 214.

The electronics assembly 202 may be coupled to a spring 224 which biases against a spring block 226. In some embodiments, as temperature increases or decreases over the course of an operation, the materials of the heat sink 214 and/or tool housing 204 may expand or contract, which causes the electronics assembly 202 to change positions along the chassis 212. The spring 224, which is fixed at one end to the chassis 212 via the spring block 226, keeps the heat sink 214 urged against the tool housing 204. In some embodiments, the outer surface 220 of the heat sink 214 has a tapered portion and the inner surface 208 of the tool housing 204 has a complementary tapered portion such that close and smooth contact is maintained between the heat sink 214 and the tool housing as the electronics assembly is urged by the spring 224. The tapered shape may also provide ease of installation as the electronics assembly 202 is inserted into the tool housing 204.

Figure 3:
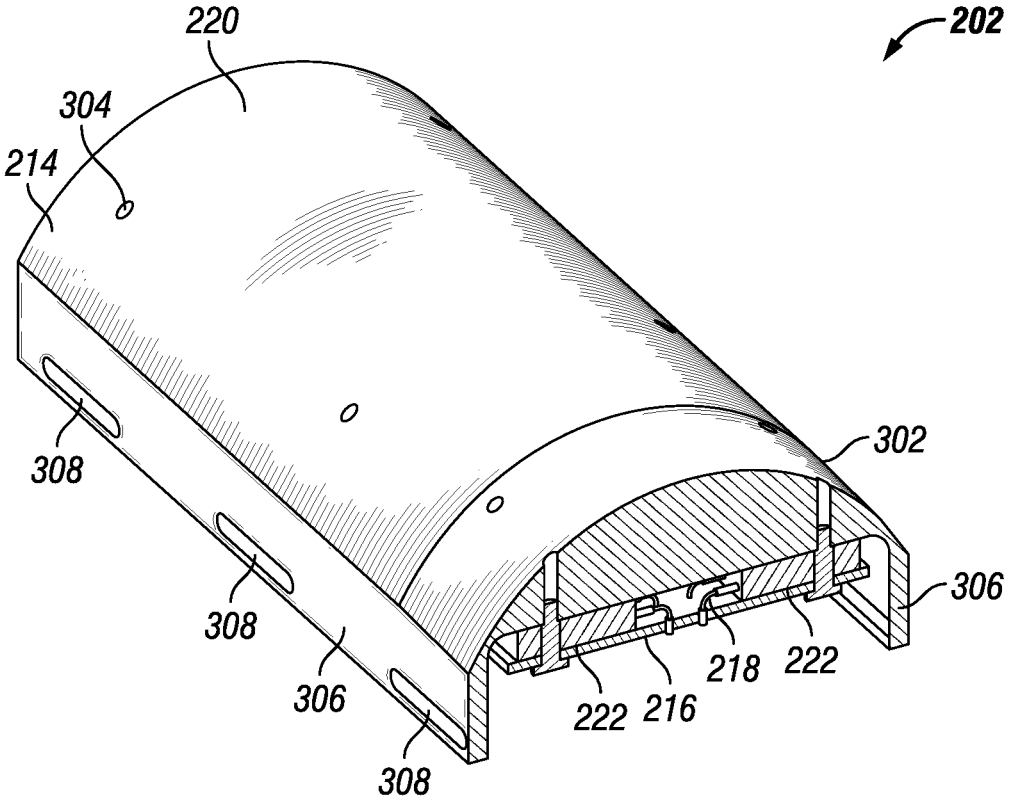
FIG. 3 is a top perspective view of the electronics assembly showing the outer surface of a heat sink.

FIG. 3 is a top perspective view of the electronics assembly 202 showing the outer surface 220 of the heat sink 214. In some embodiments, the outer surface 220 has a curved profile with a tapered portion 302. The heat sink 214 may also have one or more holes or openings 304 formed therein. In some embodiments, the heat sink 214 further includes side flanges 306 by which the electronics assembly 202 is mounted to the chassis 212. The flanges 306 may have slots 308 formed therein for coupling to the chassis 212.

Figure 4:
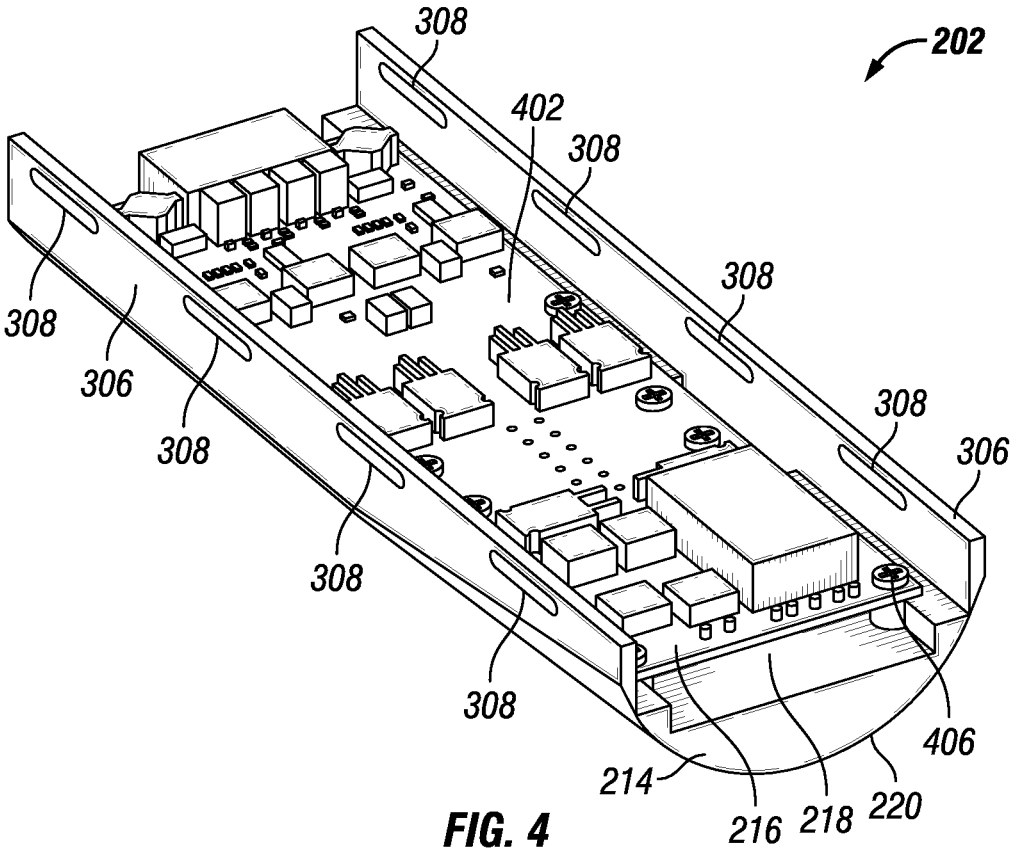
FIG. 4 is a bottom perspective view of the electronics assembly showing a circuit board assembly.
Figure 5:
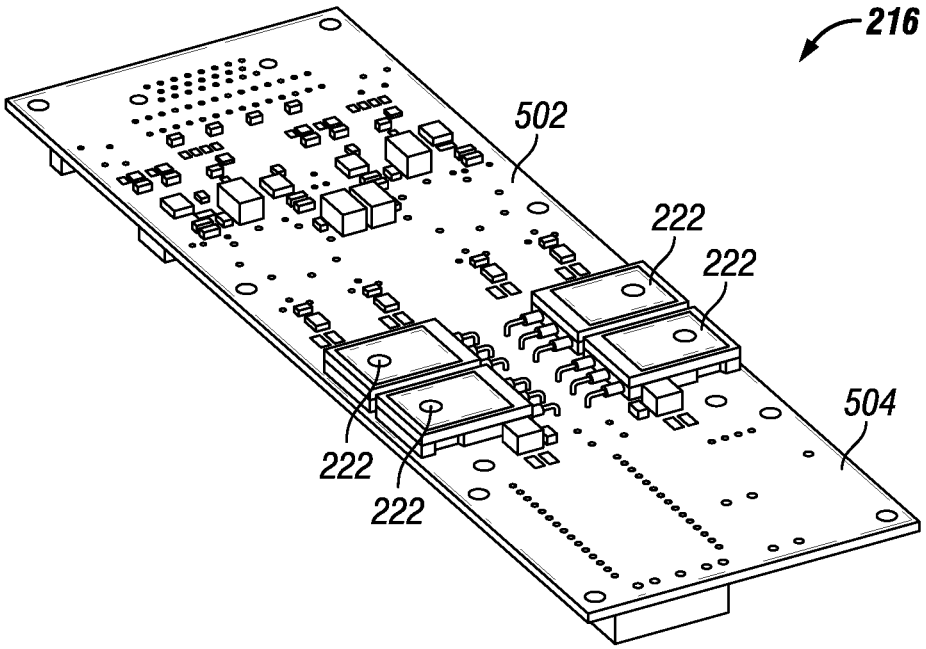
FIG. 5 shows a back side of the circuit board assembly of FIG. 4.

FIG. 4 is a bottom perspective view of the electronics assembly 202 showing the circuit board assembly 216. The circuit board assembly 216 may be mounted to the heat sink 214 on the inner surface 218 of the heat sink 214. In some embodiments, the circuit board assembly 216 is coupled to the heat sink 214 via screws 406. FIG. 4 shows a front side 402 of the circuit board assembly 216. FIG. 5 shows a back side 502 of the same circuit board assembly 216. The back side 502 of the circuit board 216 faces the inner surface 218 of the heat sink 214 when installed. The back side 502 of the circuit board assembly 216 includes the heat generating components 222 mounted on a board 504. The heat generating components 222 are mounted with the heat generating side facing away from the board 504 and in contact against the inner surface 218 of the heat sink 214 when mounted. A layer of thermal adhesive may be applied between the components 222 and the heat sink 214 to facilitate heat transfer. In some embodiments, the circuit board assembly 216 may be replaced by one or more electronic components that are not necessarily mounted on a board 502.

Figure 6:
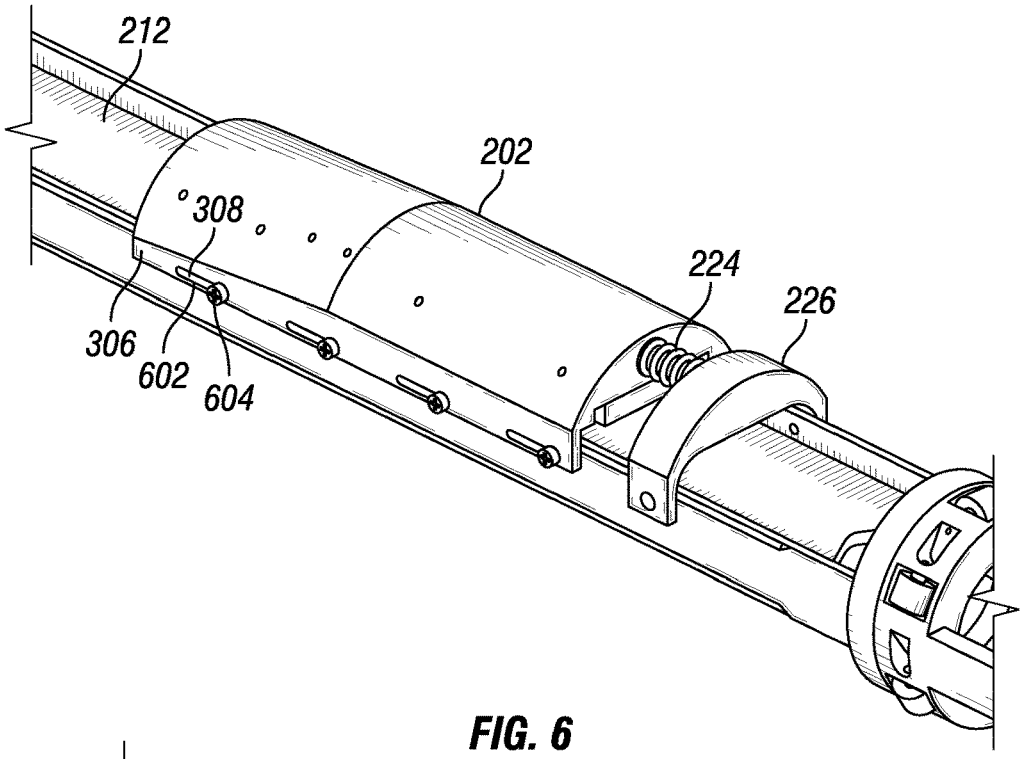
FIG. 6 illustrates a perspective view of the electronics assembly mounted to the chassis absent a tool housing.

FIG. 6 illustrates a perspective view of the electronics assembly 202 mounted to the chassis 212 absent the tool housing 204. In some embodiments, the side flanges 306 go on opposite sides of the chassis 212 and are coupled to the chassis 212 via a coupling mechanism 602. The coupling mechanism 602 may provide a certain degree of relative movement between the electronics assembly 202 and the chassis 212. For example, the coupling mechanism 602 of FIG. 6 includes the slots 308 of the heat sink 214, corresponding holes formed in the chassis 212, and corresponding screws 604 or pegs that traverse the slots 308 and holes, coupling the heat sink 214 to the chassis 212. However, the length of the slots 308 allows the electronics assembly 202 to slide laterally with respect to the chassis 212 while remaining coupled to the chassis 212. In other embodiments, the coupling mechanism 602 can be any other means of coupling to electronics assembly 202 to the chassis 212. The spring block 226 is fixed to the chassis 212 such that the electronics assembly 202 can be pushed towards the spring block 226, compressing the spring 224. In some embodiments, a second electronics assembly 202 is mounted onto an opposite side of the chassis from the illustrated electronics assembly 202 such that the tool is balanced on both sides.

Figure 7:
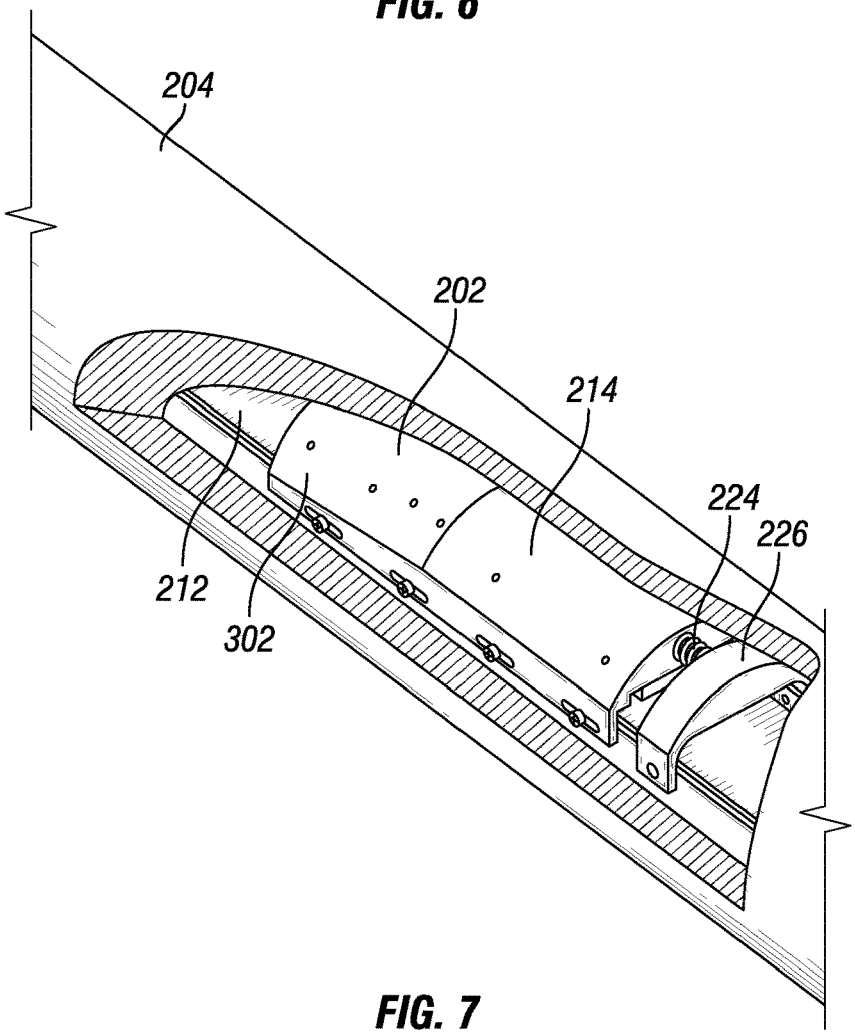
FIG. 7 illustrates a perspective cut-away view of the electronics assembly mounted to the chassis within the tool housing.

FIG. 7 illustrates a perspective cut-away view of the electronics assembly 202 mounted to the chassis 212 within the tool housing 204. The electronics assembly 202 is in full contact with the tool housing 204 via the heat sink 214. In some embodiments, when the electronics assembly 202 and chassis 212 are inserted into the tool housing 202, the tapered portion 302 of the heat sink 214 fits into a corresponding tapered portion of the tool housing 204 which pushes against the electronics assembly 202. In some embodiments, the electronics assembly 202 may be pushed up against the spring, compressing the spring, and activating a spring force. The spring force pushes the electronics assembly 202 against the tool housing 204, providing good contact for heat transfer. In some embodiments, as temperature increases or decreases over the course of an operation, the materials of the heat sink 214 and/or tool housing 204 may expand or contract, which causes the electronics assembly 202 to change positions along the chassis 212. The spring 224, which is fixed at one end to the chassis 212 via the spring block 226, keeps the heat sink 214 urged against the tool housing 204.

Figure 8:
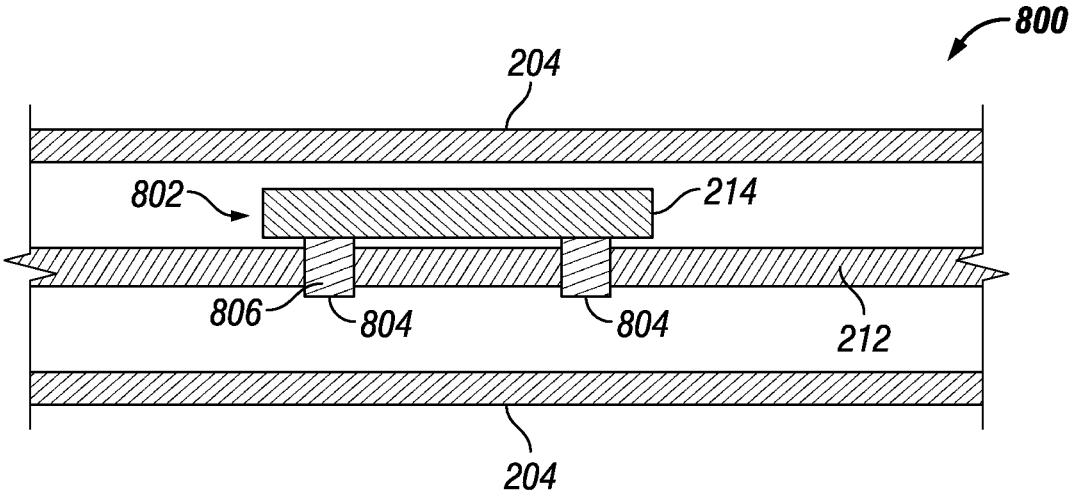
FIG. 8 a cross-sectional diagram of a portion of a downhole tool with an expandable electronics assembly in a retracted position.
Figure 9:
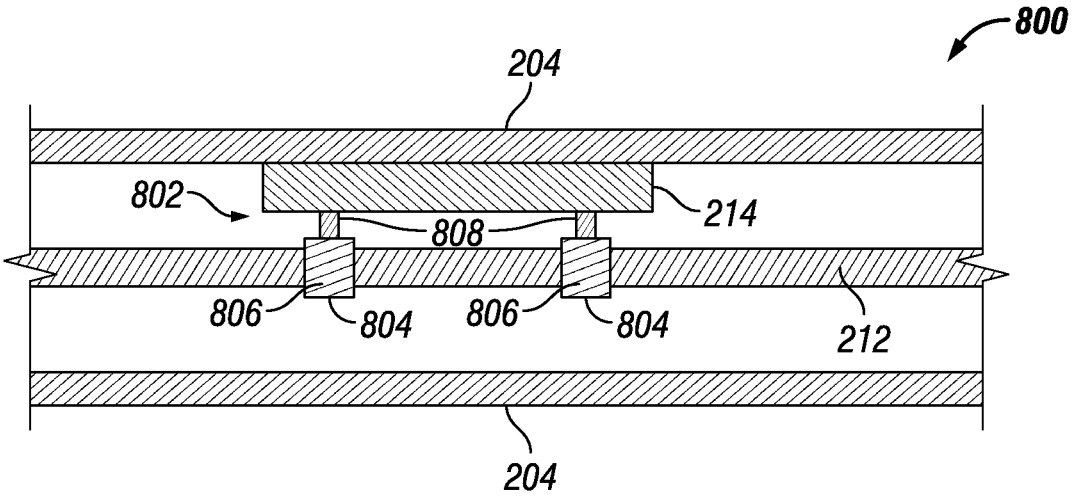
FIG. 9 a cross-sectional diagram of a portion of the downhole tool of FIG. 8 with the expandable electronics assembly in an extended position.

FIGS. 8 and 9 illustrate cross-sectional diagrams of a portion of a downhole tool 800 with an expandable electronics assembly 802. The electronics assembly 802 may be similar to or the same as electronics assembly 202 of FIG. 2. In this embodiment of the present disclosure, the electronics assembly 802 is in a retracted position (FIG. 8) until a threshold temperature is reached, at which point the electronics assembly extends into the extended position (FIG. 9). Referring to FIGS. 8 and 9, the expandable electronics assembly 802 is mounted onto the chassis 212 within the tool housing 204. The expandable electronics assembly 802 includes a heat sink 214 similar to that illustrated in FIG. 2 as well as one or more electronics components mounted thereon. The expandable electronics assembly 802 further includes one or more thermal actuators 804. The thermal actuators 804 each include a fixed base portion 806 which is coupled the chassis 212 and an extendable portion 808 coupled to the heat sink 214 configured to extend outward from the base portion 806 when a threshold temperature is reached. The threshold temperature can be measured from the thermal actuator, the ambient temperature inside the tool 800, from the heat sink 214, or anywhere else in or on the downhole tool 800.

When the thermal actuators 804 are not actuated, the heat sink 214 is retracted close to the chassis 212 and away from the tool housing 204, as illustrated in FIG. 8. This allows the chassis and electronics assembly 802 to be easily inserted into the tool housing 204 without a lot of friction. When the temperature rises and reaches the threshold temperature, the thermal actuators 804 push the heat sink 214 towards the tool housing 204 until the heat sink 214 is in full contact with the tool housing 204, as illustrated in FIG. 9. This allows heat to be transferred from the heat generating components through the heat sink 214 to the tool housing 204, and out of the tool 800.

The thermal actuators 804 illustrated and described herein are only one example of a thermal expansion device that can be used to hold the heat sink 214 away from the tool housing 204 when the temperature is below a threshold and urge the heat sink 214 into contact with the tool housing 204 when the temperature is above the threshold temperature. Other examples may include a thermal expansion material, pistons, memory metals, among others.

In addition to the embodiments described above, many examples of specific combinations are within the scope of the disclosure, some of which are detailed below:

Example 1

A downhole tool system, comprising:
a tool housing;
an chassis located within the tool housing; and
an electronics assembly positioned on the chassis within the tool housing, the electronics assembly comprising:
a heat sink comprising an inner surface and an outer surface, the outer surface having a tapered portion and in contact with the tool housing; and
one or more electronic components mounted onto the heat sink, wherein at least a portion of the one or more electronic components is in contact with the inner surface of the heat sink.

Example 2

The system of example 1, wherein the electronic components are coupled to the chassis via a coupling mechanism configured to provide a degree of relative movement between the electronic components and the chassis.

Example 3

The system of example 2, wherein the coupling mechanism comprises a peg or screw disposed through a slot.

Example 4

The system of example 1, wherein the heat sink comprises a thermally conductive material, and wherein the inner surface of the heat sink is configured to be thermally communicative with the outer surface of the heat sink.

Example 5

The system of example 1, herein the tool housing comprises an inner tapered portion having a shape complementary to the tapered portion of the heat sink.

Example 6

The system of example 1, wherein the at least a portion of the electronic components are coupled to a circuit board, the portion of electronic components comprising heat emitting surfaces, and wherein the heat emitting surfaces are in contact with the inner surface of the heat sink.

Example 7

The system of example 1, further comprising a spring member configured to bias the heat sink against the tool housing.

Example 8

A downhole tool system, comprising:
a tool housing;
an chassis located within the tool housing; and
an electronics assembly positioned on the chassis within the tool housing, the electronics assembly comprising:
a heat sink comprising an inner surface and an outer surface;
one or more electronic components mounted onto the heat sink, wherein at least a portion of the one or more electronic components is in contact with the inner surface of the heat sink; and
a thermal expansion device configured to move the heat sink upon reaching a certain temperature threshold so as to place the outer surface of the heat sink into contact with the tool housing.

Example 9

The system of example 8, wherein the at least a portion of the electronic components are coupled to a circuit board, the portion of electronic components comprising heat emitting surfaces, and wherein the heat emitting surfaces are in contact with the inner surface of the heat sink.

Example 10

The system of example 8, wherein the heat sink comprises a thermally conductive material, and wherein the inner surface of the heat sink is configured to be thermally communicative with the outer surface of the heat sink.

Example 11

The system of example 8, wherein the electronic components are mounted onto opposite sides of the chassis.

Example 12

The system of example 8, wherein the thermal expansion device comprises a thermal actuator.

Example 13

The system of example 8, wherein the electronic components are a part of an electronics assembly which further comprises a retraction mechanism configured to move the heat sink and circuit assembly inward and away from the tool housing.

Example 14

The system of example 8, wherein the thermal expansion device comprises a thermally expansive material configured to expand in volume upon reaching the temperature threshold.

Example 15

An electronics assembly for thermal management in downhole tools, comprising:

- a heat sink comprising an inner surface and an outer surface;
- a circuit assembly mounted onto the heat sink, wherein at least a portion of the circuit assembly is in contact with the inner surface of the heat sink; and
- a thermal expansion device configured to move or expand the heat sink upon reaching a certain temperature threshold.

Example 16

The electronics assembly of example 15, wherein the thermal expansion device is a thermal actuator.

Example 17

The electronics assembly of example 15, wherein the thermal expansion device comprises a thermally expansive material configured to expand in volume upon reaching the temperature threshold.

Example 18

The electronics assembly of example 15, wherein the circuit assembly comprises an electronic component coupled to a circuit board, the electronic component comprising a heat emitting surface, and wherein the heat emitting surface is in contact with the inner surface of the heat sink.

Example 19

The electronics assembly of example 15, wherein the heat sink comprises a thermally conductive material, and wherein the inner surface of the heat sink is thermally communicative with the outer surface of the heat sink.

Example 20

The electronics assembly of example 15, wherein the electronics assembly further comprises a retraction mechanism configured to retract the heat sink and circuit assembly.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A downhole tool system, comprising:

a tool housing;

a chassis located within the tool housing; and an electronics assembly positioned on the chassis within the tool housing, the electronics assembly comprising:

a heat sink comprising an inner surface and an outer surface, the outer surface having a tapered portion and in contact with the tool housing, wherein the heat sink further comprises a plurality of slots that each extending along a portion of the length of the heat sink;

one or more electronic components mounted onto the heat sink, wherein at least a portion of the one or more electronic components is in contact with the inner surface of the heat sink;

a plurality of fasteners, each fastener extending through a respective slot of the plurality of slots to couple the heat sink to the chassis and allow the heat sink and the one or more electrical components to slide laterally with respect to the chassis; and a spring member configured to bias the heat sink against the tool housing.

2. The system of claim 1, wherein fastener comprises a peg or screw.

3. The system of claim 1, wherein the heat sink comprises a thermally conductive material, and wherein the inner surface of the heat sink is configured to be thermally communicative with the outer surface of the heat sink.

4. The system of claim 1, wherein the tool housing comprises an inner tapered portion having a shape complementary to the tapered portion of the heat sink.

5. The system of claim 1, wherein the at least a portion of the electronic components are coupled to a circuit board, the portion of electronic components comprising heat emitting surfaces, and wherein the heat emitting surfaces are in contact with the inner surface of the heat sink.

6. An electronics assembly for mounting on a chassis in downhole tools, the electronics assembly comprising:

a heat sink comprising an inner surface and an outer surface;

a circuit assembly mounted onto the heat sink, wherein at least a portion of the circuit assembly is in contact with the inner surface of the heat sink; and wherein the heat sink further comprises a plurality of slots that each extending along a portion of the length of the heat sink, each of the plurality of slots configured to receive a fastener to couple the heat sink to the chassis and allow the heat sink and the circuit assembly to slide laterally with respect to the chassis.

7. The electronics assembly of claim 6, wherein the fastener comprises a peg or screw.

8. The electronics assembly of claim 6, wherein an outer surface of the heat sink comprises a tapered portion.

9. The electronics assembly of claim 6, wherein the circuit assembly comprises an electronic component coupled to a circuit board, the electronic component comprising a heat emitting surface, and wherein the heat emitting surface is in contact with the inner surface of the heat sink.

10. The electronics assembly of claim 1, wherein the heat sink comprises a thermally conductive material, and wherein the inner surface of the heat sink is thermally communicative with the outer surface of the heat sink.

* * * * *